US006719162B2

(12) United States Patent
Przytulla

(10) Patent No.: US 6,719,162 B2
(45) Date of Patent: Apr. 13, 2004

(54) PALLET CONTAINER

(75) Inventor: Dietmar Przytulla, Kerpen (DE)

(73) Assignee: Mauser-Werke GmbH & Co. KG, Brühl (DE)

( * ) Notice: Subject to any disclaimer, the term of this patent is extended or adjusted under 35 U.S.C. 154(b) by 0 days.

(21) Appl. No.: 10/201,462

(22) Filed: Jul. 23, 2002

(65) Prior Publication Data

US 2003/0015529 A1 Jan. 23, 2003

Related U.S. Application Data

(63) Continuation of application No. PCT/EP01/13650, filed on Nov. 23, 2001.
(60) Provisional application No. 60/253,264, filed on Nov. 27, 2000.

(30) Foreign Application Priority Data

Nov. 23, 2000 (DE) ..... 200 19 974

(51) Int. Cl.[7] ..... B65D 90/22
(52) U.S. Cl. ..... 220/23.91; 206/386
(58) Field of Search ..... 220/23.91, 4.13, 220/9.1, 9.4; 206/512, 599, 386

(56) References Cited

U.S. PATENT DOCUMENTS

| | | | | |
|---|---|---|---|---|
| 4,947,988 A | | 8/1990 | Schutz | |
| 5,111,937 A | | 5/1992 | Schutz | |
| 5,197,601 A | * | 3/1993 | Sterett | 206/511 |
| 5,447,250 A | * | 9/1995 | Schutz | 220/403 |
| 5,465,865 A | | 11/1995 | Coombes | |
| 5,544,777 A | * | 8/1996 | Watson | 220/4.13 |
| 5,895,540 A | | 4/1999 | David et al. | |
| 5,924,589 A | * | 7/1999 | Gordon | 220/23.91 |
| 6,247,594 B1 | * | 6/2001 | Garton | 206/512 |
| 6,360,907 B1 | * | 3/2002 | Przytulla | 220/23.91 |

FOREIGN PATENT DOCUMENTS

| | | |
|---|---|---|
| DE | 91 05 264 U | 7/1991 |
| EP | 0 995 696 A | 4/2000 |
| FR | 2 675 774 A | 10/1992 |

* cited by examiner

*Primary Examiner*—Joseph Man-Fu Moy
(74) *Attorney, Agent, or Firm*—Henry M. Feiereisen; Ursula B. Day

(57) ABSTRACT

The invention is directed to a pallet container assembly with a thin-walled rigid inner container of thermoplastic material for the storage and transport of liquid or flowable contents, including a cage-like bar frame closely surrounding as support jacket the inner plastic container, and a bottom pallet for placement of the inner plastic container and secure attachment of the support jacket, wherein there are provided, within the support area of the inner plastic container on the surface of the bottom pallet optionally on the surface of an intermediate plate, respective means (form-fitting means/frictional connection means) which—as viewed in the direction of the horizontal plane—result in a substantial increase of the slip resistance between the downwardly pointing outer surface of the bottom pallet or the intermediate plate.

14 Claims, 5 Drawing Sheets

PALLET CONTAINER

CROSS-REFERENCES TO RELATED APPLICATIONS

This application is a continuation of prior filed copending PCT International Application No. PCT/EP01/13650, filed Nov. 23, 2001.

This application claims the priority of German Patent Application Serial No. 200 19 19 974.9 filed Nov., 2000, the subject matter of which is incorporated herein by reference.

This application claims benefit of prior filed provisional application Appl. No. 60/253,264 filed Nov. 27, 2000.

BACKGROUND OF THE INVENTION

The invention relates, in general, to a pallet container and more particularly to a pallet container of a type having a thin-walled rigid inner receptacle, preferably made from thermoplastic material for the storage and transport of liquid or free-flowing goods, wherein the plastic container is closely surrounded by an outer cage jacket as a supporting casing for the plastic container and a bottom pallet on which the thermoplastic receptacle is supported and which is firmly secured to the supporting casing.

Pallet containers of the type having a support jacket such as for example a wire cage jacket type or a cage jacket with horizontal and vertical bars are generally known in the prior art; e.g. from U.S. Pat. No. 4,676,373 (Schn./W).

The cage jackets in the pallet containers of the prior art are secured to the bottom pallet, which may be configured as a flat pallet from plastic or wood, or as a steel bar frame and is usually realized by fastening means such as for example, screws, brackets, clamps, clasps or claws that engage the lower horizontally surrounding cage bars. These fasteners are usually nailed, riveted, pinned screwed or welded to the upper plate or the upper outer edge of the pallet. In case where the pallet container has a support jacket of the bar cage jacket type, the cage bars can be configured as open or closed profiles having round cross section or rectangular cross section.

For industrial use, the pallet containers have to pass an official approval inspection and meet certain quality criteria. For example, the filled pallet containers have to undergo interior pressure tests and drop tests from specific heights, which are also conducted at extremely low temperatures (−20° C.). The worst case drop is a diagonal drop onto the lower pallet end side, which carries the bottom outlet valve of the inner plastic receptacle.

As has been shown in such drop tests, the inner plastic receptacle tends to shift relative to the bottom pallet during ground impact. Through the kinetic impact energy, especially at the impact end wall, the bars become severely deformed and in neighboring lateral peripheral regions are partly torn from the bottom pallet. The securement of the lower rim of the cage jacket to the bottom pallet thus is a crucial problem area. Since the attachment of the cage jacket is provided only at a few areas, the cage jacket, especially when a bar cage is involved, is deformed very unevenly and warps, whereby the thin-walled plastic receptacle can be damaged by torn off cage parts.

Pallet containers or combination-IBCs (IBC= Intermediate Bulk Container) of the type involved here are used for transporting liquids. Preferably, they usually have a filling volume of 1000 liters and consist of a pallet, a cage jacket, which is attached to the bottom pallet, and an inner receptacle made from PE-HD, which is firmly surrounded by the cage jacket, and which has an upper fill opening and a lower outlet fitting.

Upon diagonal drop testing at the lower critical pallet end face (the area where the outlet fitting of the inner container is disposed), the inner container with the liquid content has the tendency of lateral slipping and shifting in the direction of the forward or lower cage wall. The surge forces of the content and the thrust force of the inner container must be absorbed primarily by the forward cage wall. As a result of the ground impact of a filled pallet container during the diagonal drop test quite significant elastic and plastic, i.e. permanent, deformations are incurred; which lead to catastrophic deformations and damage to the inner container, when the cage jacket and pallet have insufficient strength. The area around the outlet fitting is hereby predominantly at risk.

The test conditions during drop testing include that the inner container must be absolutely tight, without leakage of any content from the outlet fitting or from the overstressed stretching areas of the inner plastic container, and that the pallet container is still maneuverable, i.e. that it can be picked up by a fork lift and be able to be transported. These are essential preconditions for the pallet container to receive official approval for use with hazardous liquid contents.

SUMMARY OF THE INVENTION

According to one aspect of the present invention, an improved pallet container is provided which is designed to obviate the afore-stated shortcomings and drawbacks and which is configured with improved drop impact stability and increased strength against mechanical stress, in particular high drop strength, and which achieves with simple constructive means a decrease of transverse forces on the wall of the cage-like bar frame during diagonal drop.

Another aspect of the present invention is to provide a pallet container suitable for transporting dangerous liquids up to the highest standard of quality to thereby enable issuance of a respective official permit for the pallet container for application or use with liquids in the upper hazard class.

These aspects, and others which will become apparent hereinafter, are attained in accordance with the present invention wherein a pallet container comprises a bottom pallet; a thin-walled rigid inner receptacle for storage and transport of liquid or free-flowing contents; and a cage-like bar frame closely surrounding the receptacle and securely connected with the bottom pallet, wherein the surface area of the bottom pallet which is bounded by the support area of the inner plastic container, or optionally an intermediate plate disposed between the surface area of the bottom pallet and the outer surface of the inner container bottom, is provided with means for increasing slip resistance relative to the horizontal plane, between a downwardly pointing outer surface of the inner container bottom and an upwardly pointing surface of the bottom pallet.

The pallet container according to the invention is based on the recognition that the comparably smooth bottom of the inner plastic container does not have a substantial slip resistance upon the comparably smooth surface of the bottom pallet or an intermediate plate disposed, optionally in-between e.g. as dampening element or as support plate of sheet metal or plastic, e.g. foamed polystyrene on a metal frame pallet, when the pallet container is positioned at an inclination and in particular during a diagonal drop, so that the filled inner container is able to slide to the side without appreciable friction resistance. By providing the aforedescribed surfaces with slip-resistant or slip-reducing means it has been found that at a diagonal ground impact, the kinetic energy within the dropping filled inner plastic container is consumed at least in part by the friction increasing means and the entire impact energy does not have to be absorbed by the lower cage basket wall.

As a consequence, the inner container is substantially prevented from shifting relative to the pallet during the drop test, and stress relief of the forward and lower support frame is realized. As a result, less deformation occurs with the cage frame of a pallet container configured in accordance with the invention which makes the pallet container suitable for application with hazardous liquid and flowable contents up to class 6, the highest approval quality.

According to one embodiment of the invention, the bottom wall of the inner plastic container is provided with projections which project outwards i.e. downwards, and respective dimples, which are formed in the surface of the intermediate plate or/and in the surface of the bottom pallet and point inwards i.e. downwards, for interlocking engagement in positive manner.

The pallet container known from the afore-mentioned U.S. Pat. No. 4,676,373 discloses a collecting trough which is inset in mid-section of the bottom wall of the inner container between two pallet boards of a wood pallet and extending to the outlet valve, however, this inset collecting trough is not bounded within the support surface inner container/bottom pallet but rather extends to the forward edge of the bottom pallet. Since it does not extend across, the collecting trough does not provide protection for the outlet valve as the inner container can slip unimpeded in the direction of the forward pallet edge. An effective positive connection within the meaning of the present invention, i.e. transverse to the direction of the forward pallet edge for protection of the outlet valve, is neither provided nor suggested.

According to another preferred embodiment of the invention, dimples, which point inwards i.e. upwards are provided within the bottom wall of the inner plastic container, and projections, which are formed in the surface of the intermediate plate or/and in the surface of the bottom pallet and point outwards i.e. upwards, for interlocking engagement in positive manner to thereby establish a form-fitting connection. In order to provide a sufficient effect as "slip brake", the interlocking form-fitting elements (anti slip elements) should have an engagement height of about 5 mm to 50 mm, preferably about 20 mm.

The form-fitting elements can hereby advantageously be slanted to the side to permit a slide-off of the inner container in extreme load situations and to thereby preclude a tearing of the plastic bottom wall. The slant of the form-fitting elements should have an angle between about 45° and 85°, preferably about 80°.

According to a further embodiment of the invention, the form-fitting elements have an outwardly limited flat extension within the support surface of the inner plastic container upon the bottom pallet and are configured, e.g. as circular, triangular or polygonal form-fitting element. According to another variation, the form-fitting elements may have a linear extension and configured, e.g., as circular, triangular, polygonal or cross-shaped form-fitting element, which is open at least to one side to enable also an emptying of residue.

The form-fitting elements include elevations on the pallet surface and respective indentations in the support surface of the inner container bottom, or elevations, i.e. projections, in the support surface of the inner container bottom and respective recesses (=indentations) in the pallet surface. Both variations may be realized side-by-side at the same time.

The inventive form-fitting elements, arranged within the support surface and outwardly limited, effectively inhibit or reduce a slip-off of the inner container in all possible directions.

A form-fitting element may be made, e.g., of a flat metal plate, plastic plate or wooden plate, having a downwardly projecting pin e.g. with having a diameter of about 200 mm, height of about 30 mm, pin diameter of about 25 mm, pin height of about 40 mm. The pallet surface has formed therein, e.g. at four locations corresponding indentations for example bores, for insertion of the pins of the form-fitting elements. The support surface of the bottom of the inner container must then have corresponding dimples or indentations at respective locations. In this simple manner, each existing bottom pallet of wood, plastic or steel, can be retrofitted for such pallet containers, e.g., when reconditioning a used pallet container and then utilizing a new inner container with respective dimples in the bottom.

According to a preferred embodiment, the bottom of the inner container is constructed along the central pinch-off seam with at least one outwardly i.e. downwardly projecting pin projection which engages in a corresponding recess or slit in the top of the bottom pallet or interposed intermediate plate, and is secured, e.g., by means of a pin inserted transversely at the underside of the pallet deck. In this way, the common disadvantage of an upward pulling of the bottom of the inner container, as a result of shrinkage stress in the thicker pinch-off seam, and impediment to a complete emptying of residue from the inner container are further prevented.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
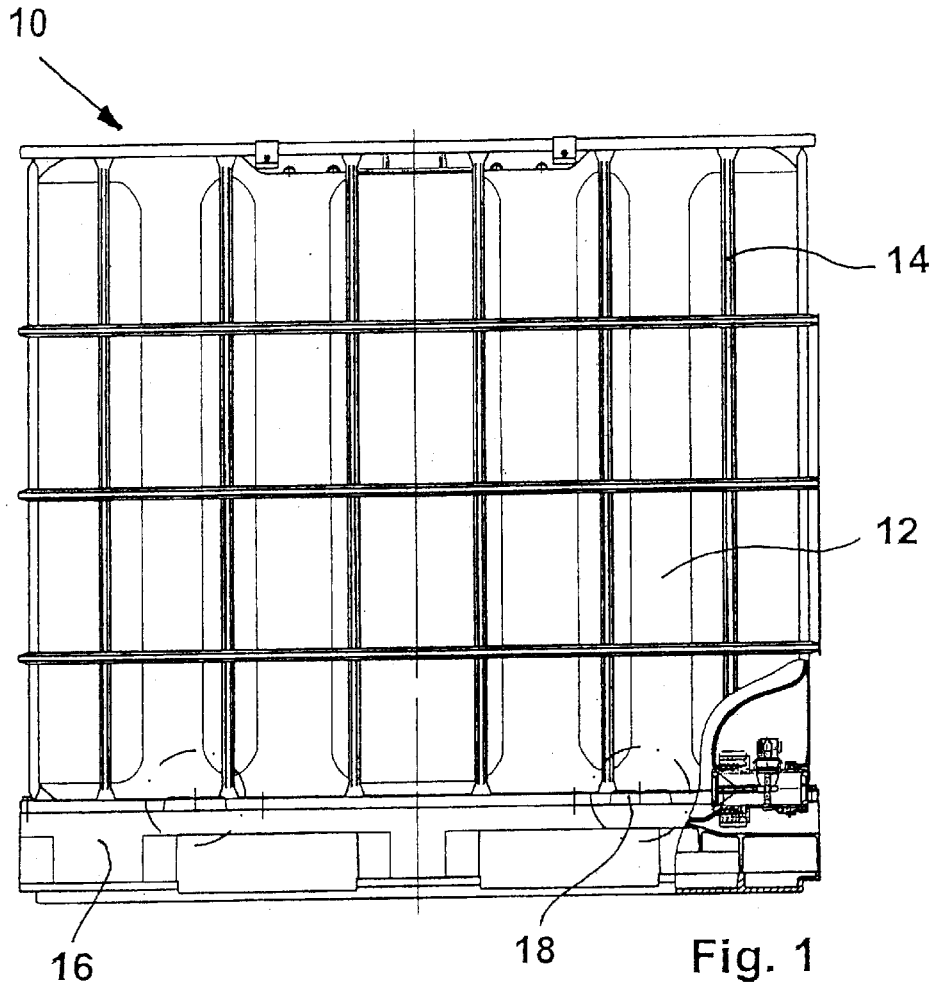
FIG. 1 is a side view of a pallet container according to the invention.

The pallet container 10 shown in FIG. 1 includes a thin-walled rigid inner container 12 of thermoplastic material for storage and transport of liquid and flowable contents, a cage-like bar frame 14, which closely surrounds as support jacket the inner plastic container 12, and a bottom pallet 16 for placement of the inner plastic container 12 and secure fixation to the cage-like bar frame 14. The circles shown in the bottom region of the inner container and top of the bottom pallet 16 should illustrate the application site of the form-fitting element 18 of the present invention. An additional intermediate plate can be arranged between inner container 12 and bottom pallet 16, which is made e.g. of steel sheet or plastic for covering an open bar frame pallet, or which is made of foamed polystyrene to serve as dampening element. If an additional intermediate plate is so arranged, then the form-fitting means according to the invention, such as e.g. several form-fitting elements, are provided between these three parts. They are in any event in direct effective contact with the bottom of the inner container.

Figure 2:
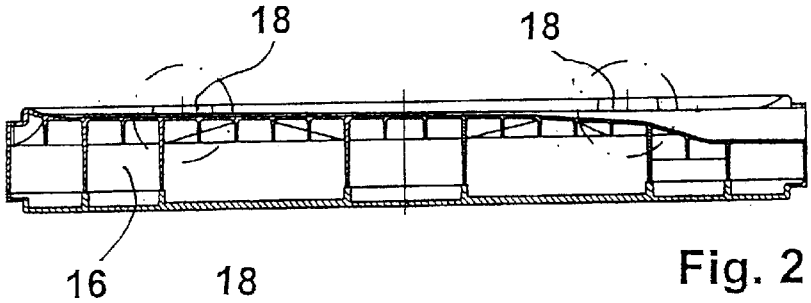
FIG. 2 is a longitudinal section through a plastic bottom pallet.
Figure 3:
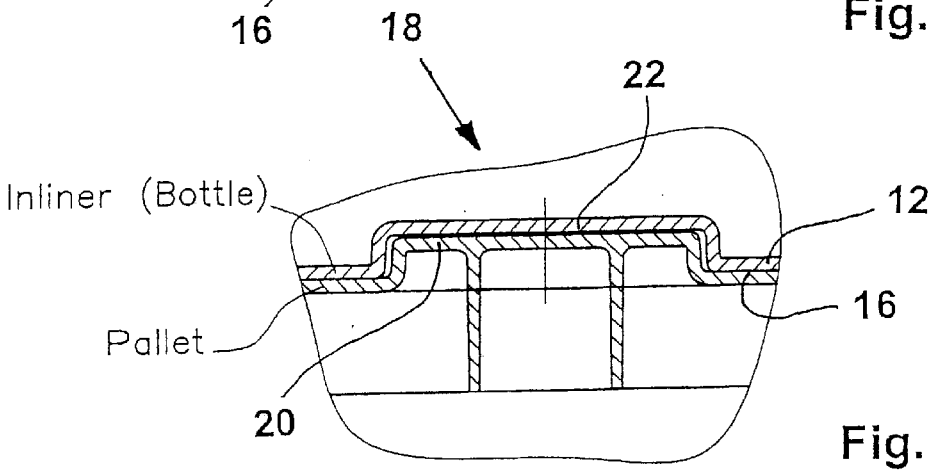
FIG. 3 is a schematic cutaway view of an inner container and bottom pallet.

In FIG. 2, the form-fitting means 18 are also marked by circles as illustrated. A form-fitting connection is realized by a dimple 22 in the bottom of the inner container 12 and a respective elevation or a projection 20 on the top of the bottom pallet 16, as schematically illustrated in FIG. 3. The arching or the projection 20 on the pallet top may also be realized by separate attachment elements or insert elements, optionally, with desired breaking point (cf. FIGS. 6 and 7).

Figure 4:
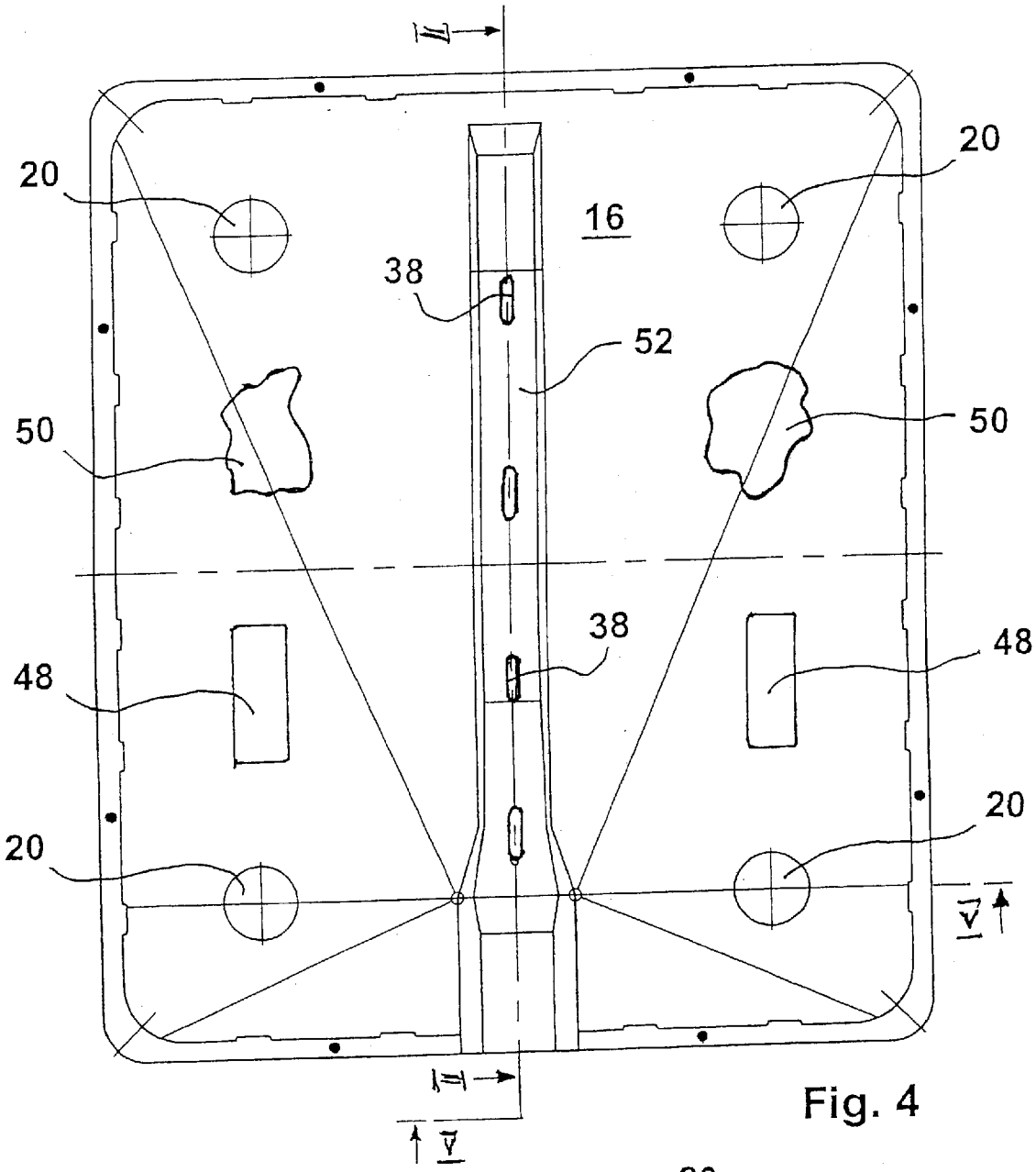
FIG. 4 is a top view of a bottom pallet according to the invention.

FIG. 4 shows in a plan view the bottom pallet 16 with four round shaped form-fitting elements 20 in the corner areas. At respective locations in the bottom, the inner container is provided with the upwardly directed indentations. Furthermore, additionally, or as alternative solution, two Velcro strips 48 and two bonding pads 50 are illustrated. The bonding pads may be realized, e.g., by a double-stick film or by areas coated flatly with adhesive. Likewise, the Velcro strips are bonded to the bottom pallet and the bottom of the inner container. Advantageously, these frictional connection and adhesive connection based elements may also be retrofitted for each of the existing pallet containers.

The surface of the bottom pallet 16 is—like correspondingly the bottom of the inner container, configured slightly or flatly inclined funnel shaped toward the central center through 52, which leads to the outlet fitting. Provided within the center trough 52 are several slits 38 for positive engagement of respective pin-like projections 30 of the bottom of the inner container 12, when the inner container 12 is placed thereon.

Figure 5:
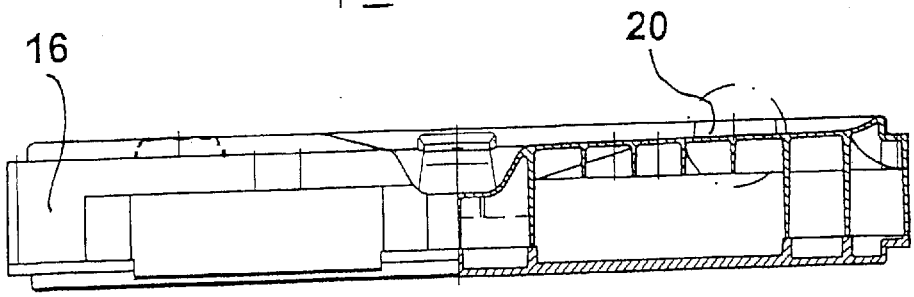
FIG. 5 is a partial cross section through the bottom pallet of FIG. 4.

FIG. 5 shows a partial section through the right-hand lower form-fitting element 20 (marked by circle drawn in dashdot line).

Figure 6:
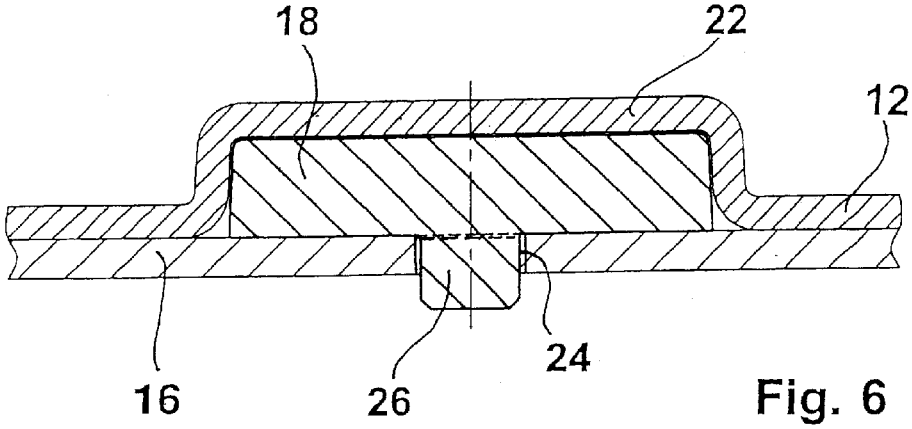
FIG. 6 is a partial view of inner container and bottom pallet with form-fitting element.

As shown in FIG. 6, a form-fitting element 18 may be made, e.g., of a flat metal plate, plastic plate or wooden plate, having a downwardly projecting pin 26 such as for example, diameter of about 200 mm, height of about 30 mm, pin diameter of about 25 mm, pin height of about 40 mm. The pallet surface has formed therein corresponding indentations, configured as bores 24 here, at e.g. four locations, for insertion of the pins 26 of the form-fitting elements 18. The bottom of the inner container 12 must then have dimples 22 or indentations at respective locations. The pins 26 may be provided with a desired breaking point, which tears off when subjected to overload, so that the bottom of the inner container cannot be damaged.

Figure 7:
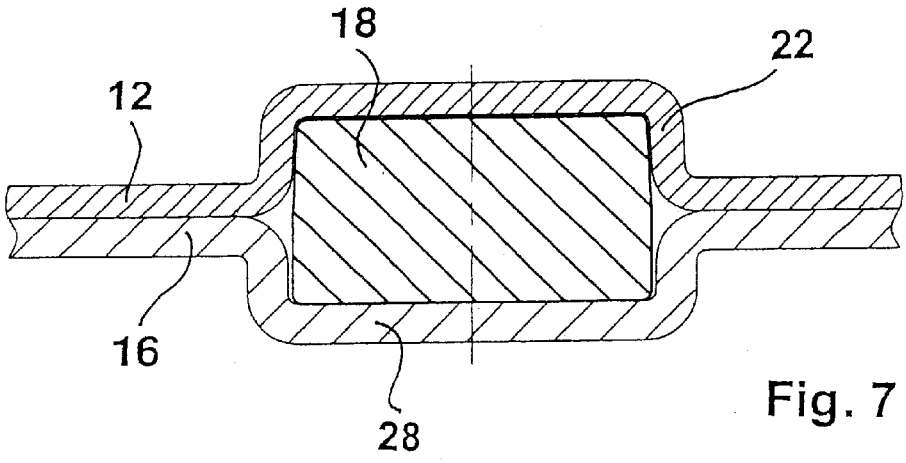
FIG. 7 is a partial view of inner container and bottom pallet with form-fitting element.

A slightly different feature is illustrated as seen in FIG. 7. Here, e.g., a round, form-fitting element 18 engages simultaneously upwards into the dimple 22 of the inner container 12 and downwards into a respective dimple 28 in the support surface of the bottom pallet 16 to establish an effective positive connection along the horizontal plane.

Figure 8:
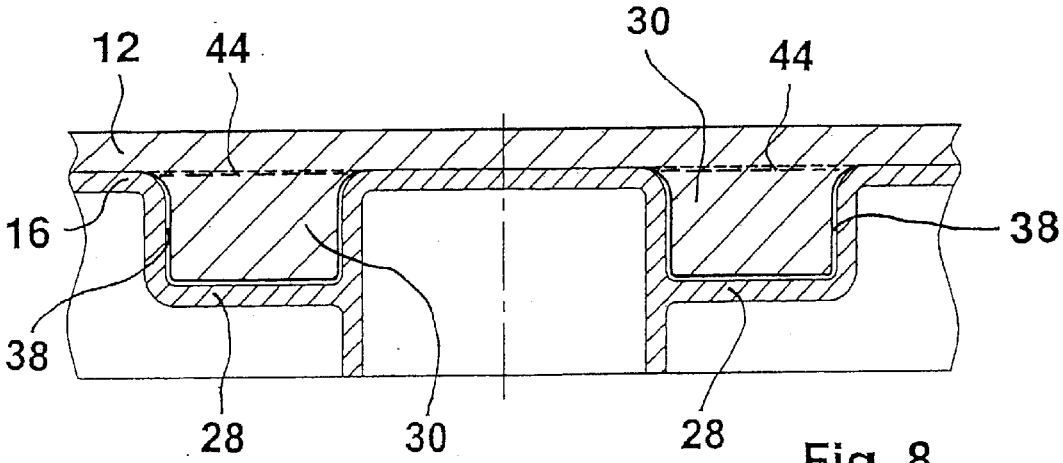
FIG. 8 is a partial view of inner container and bottom pallet with form-fitting element.
Figure 9:
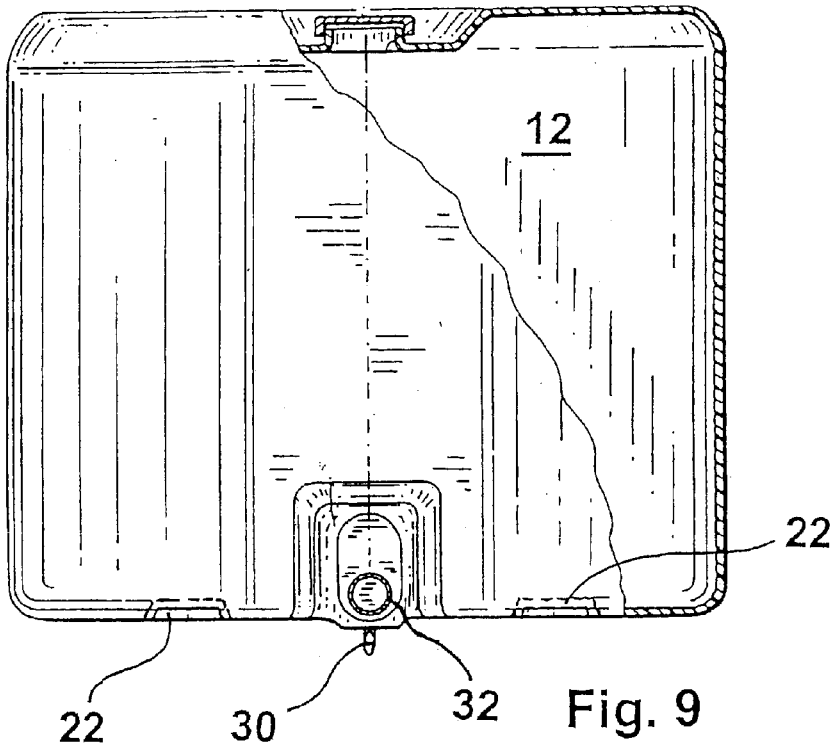
FIG. 9 is a front view of an inner container with form-fitting elements.
Figure 10:
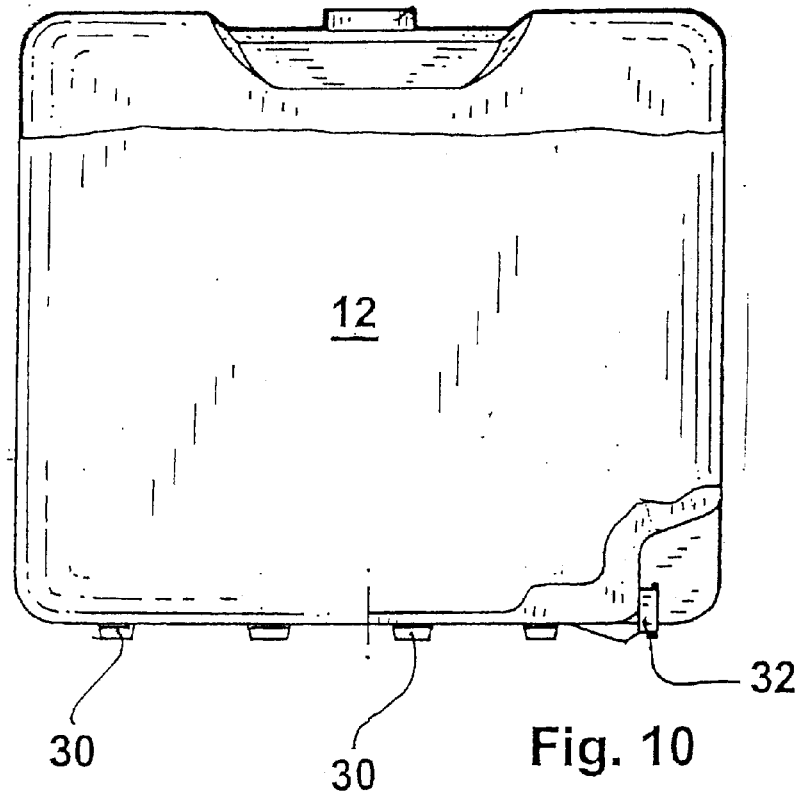
FIG. 10 is a side view of the inner container with form-fitting elements.

FIG. 8 shows partially a portion of the bottom of the inner plastic container 12 with two pin-like projections 30 which positively engage in respective dimples 28 or slits 38 in the surface of the bottom pallet 16. The projections 30 may be configured round shaped or may be of slender length and they are molded during blow-molding process as integral piece in the pinch-off seam from the bottom flash of the inner container 12 and may also be provided with a respective desired breaking point 44. FIG. 9 illustrates a front view to show the projections 30 formed along the pinch-off seam on the bottom of the inner container 12, whereas FIG. 10 shows a side view thereof. The projections 30 positively engage in the respective slits 38 of the bottom pallet 16 (cf. FIG. 4).

Figure 11:
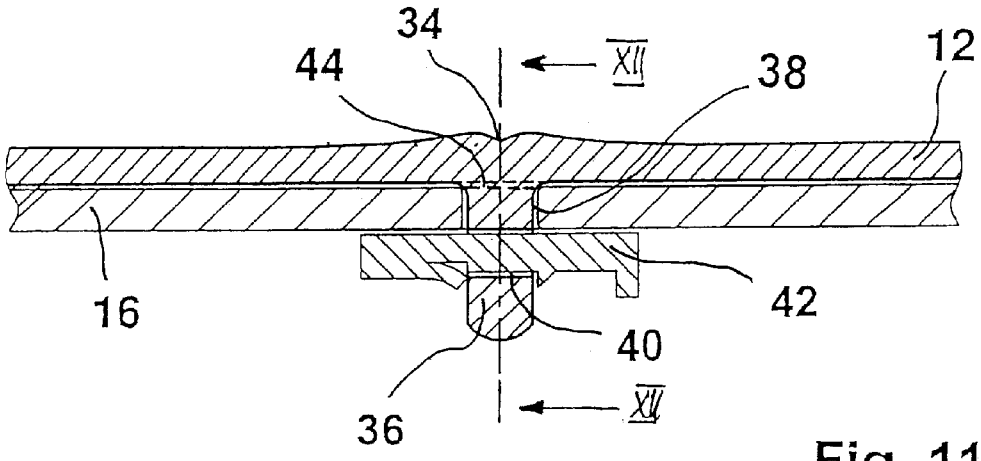
FIG. 11 is a partial view inner container and bottom pallet with form-fitting element.

The partial sectional illustration of FIG. 11 shows yet a particular embodiment with a pin projection 36 along the pinch-off seam 34 on the bottom of the inner container 12. The pin 36 is inserted in a slit 36 in the top deck of the bottom pallet 16 and is securely fixed against the pallet top deck by means of a securing pin 42 placed across through a respectively provided bore 40 from below.

Figure 12:
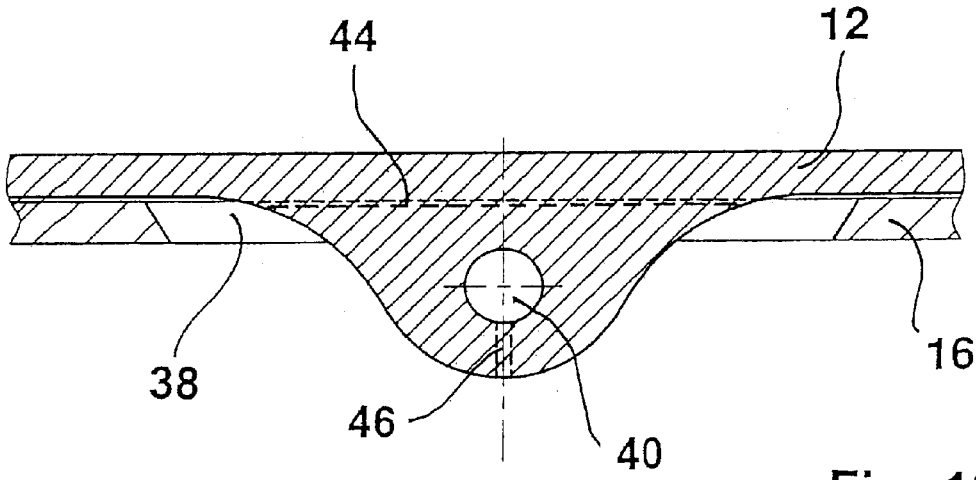
FIG. 12 is a cross sectional view of the form-fitting element of FIG. 11.

A side view of the pin 36 is depicted in FIG. 12 and also provided with desired breaking points 44 and/or 46. The desired breaking points 44, 46 are intended to safely prevent overstress of the bottom of the inner container in case of extreme load.

It is especially relevant that the form-fitting elements, frictional engagement elements and bonding elements minimize a slip-off of the inner container on the pallet surface in any direction and especially toward the forward pallet edge, where the outlet fitting of the inner container is located, and appreciably reduce thrust forces of the inner container upon the forward cage wall, and become effective by their "restraining action".

The illustrated measures enable retrofitting in accordance with the present invention of each and every existing pallet of wood, plastic or steel for all pallet containers.

While the invention has been illustrated and described as embodied in a pallet container, it is not intended to be limited to the details shown since various modifications and structural changes may be made without departing in any way from the spirit of the present invention.

What is claimed as new and desired to be protected by Letters Patent is set forth in the appended claims:

What is claimed is:

1. A pallet container assembly comprising:

a bottom pallet providing at least one upper surface area a thin-walled rigid inner receptacle for storage and transport of liquid or free-flowing contents; and a cage-like bar frame closely surrounding the receptacle and securely connected with the bottom pallet, wherein the upper surface area provided at the bottom pallet and bounded by a support area of the inner plastic container is provided with means for increasing slip resistance between a downwardly pointing outer surface of the inner container bottom and an upwardly pointing corresponding surface at the bottom pallet., wherein the means for increasing the slip resistance are configured as form-fitting elements, said formfitting elements provided in the bottom wall of the inner plastic container and in the at least one upper surface area provided at the bottom pallet, are configured as downwardly pointing material projections and wherein the corresponding surface at the bottom pallet is provided with one of respective dimples or slits, that are pointing downwardly for interlocking engagement in positive manner and relative to the horizontal plane.

2. The pallet container assembly of claim 1, wherein the at least one upper surface area is an intermediate plate provided between the bottom pallet and the outer surface of the inner container bottom with means for increasing slip resistance between the downwardly pointing surface of the inner container bottom and the upwardly pointing surface of the bottom pallet.

3. The pallet container assembly of claim 1, wherein the means for increasing the slip resistance are selected from the group consisting of frictional connection elements and attachment elements and combinations thereof.

4. The pallet container assembly of claim 1, wherein the bottom wall of the inner plastic container is provided with dimples which point upwards, and one of projections or attachments which are formed in the corresponding surface at the bottom pallet and point upwards, for interlocking engagement in positive manner to establish a form-fitting connection.

5. The pallet container assembly of claim 2, wherein the bottom wall of the inner plastic container and the surface of the intermediate plate are provided with upwardly pointing dimples and the surface of the bottom plate with respective downwardly pointing dimples, and wherein a form-fitting element is placed into the dimples for positive engagement in both corresponding dimples to thereby establish a form-fitting connection.

6. The pallet container assembly of claim 1, wherein the interlocking form-fitting elements have an engagement height of about 5 mm to 50 mm.

7. The pallet container assembly of claim 6, wherein the formfitting element is about 20 mm.

8. The pallet container assembly of claim 5, wherein the form-fitting elements are sloped laterally at an angle between 45° and 85°.

9. The pallet container assembly of claim 8, wherein the form-fitting elements are sloped laterally at an angle of about 80°.

10. The pallet container assembly of claim 5, wherein the form-fitting elements which are interlocking the support surface of the inner plastic container and the upper surface at the bottom pallet extend in a two dimensional shape selected from the group consisting of circular, triangular and polygonal.

11. The pallet container assembly of claim 5, wherein the form-fitting elements which are interlocking the support surface of the inner plastic container and the corresponding upper surface area at the bottom pallet extend in a linear configuration selected from the group of toroidal, triangular, polygonal or cross-shaped which is open at least to one side.

12. The pallet container assembly of claim 3, wherein the frictional connection elements and bonding elements are selected from the group of bonding pads, adhesive strips, Velcro elements and bonding areas and are provided between at least the surface area at the bottom pallet and the bottom of the inner container to establish one of an adhesive or a bonding effect in the direction of the horizontal plane suitable for sustaining the stress on the pallet container and for detachment in vertical direction when the inner container is replaced.

13. The pallet container assembly of claim 1, wherein the bottom of the inner container is constructed along a central pinch-off seam with at least one outwardly projecting pin projection for securely engaging in a corresponding recess or slit in the corresponding upper surface area at the bottom pallet.

14. The pallet container assembly of claim 1, wherein the form-fitting elements are provided with at least one desired breaking point.

* * * * *